United States Patent [19]

Nilsson

[11] 4,138,081

[45] Feb. 6, 1979

[54] FOLDABLE RHOMBIC HOOK BLANK

[76] Inventor: Ragnar H. Nilsson, Am Ameisenbrunnen 4, Hanau am Main, Fed. Rep. of Germany

[21] Appl. No.: 865,103

[22] Filed: Dec. 27, 1977

[30] Foreign Application Priority Data

Dec. 31, 1976 [DE] Fed. Rep. of Germany ... 7641142[U]

[51] Int. Cl.[2] ..... A47G 1/16; A47G 5/08

[52] U.S. Cl. ..... 248/300; 248/205 A

[58] Field of Search ..... 248/300, 205 A, 308, 248/304, 301; 24/230.5 R

[56] References Cited

U.S. PATENT DOCUMENTS

| | | | |
|---|---|---|---|
| 637,542 | 11/1899 | Wilson | 248/300 |
| 1,026,711 | 5/1912 | Shover | 248/205 R |
| 1,569,773 | 1/1926 | Miller | 248/205 R |
| 1,700,253 | 1/1929 | Davis | 248/301 X |
| 3,466,071 | 9/1969 | Reed | 248/300 X |
| 3,469,811 | 9/1969 | Crain | 248/300 X |

*Primary Examiner*—J. Franklin Foss

*Attorney, Agent, or Firm*—Sughrue, Rothwell, Mion, Zinn and Macpeak

[57] ABSTRACT

A foldable cardboard hook blank formed as a rhombus 14 with fold lines 16, 20, 24 and cuts 22 defining congruent triangle pairs 26, 28, 32. Upon folding the triangles 28 remain in a common plane for attachment to a support surface, the triangles 26 partially overlie each other and also lie in said common plane, and the triangles 32 form the hook body.

4 Claims, 4 Drawing Figures

FOLDABLE RHOMBIC HOOK BLANK

BACKGROUND OF THE INVENTION

This invention refers to a folding pattern for a hook of cardboard, paper or any other foldable material for the suspension of objects of all kinds, especially articles of clothing, hand-bags and towels.

The problem is to design a folding pattern for such a hook of planar material by unfolding at certain marked lines in such a manner that even when manufacturing a large number of pieces, there will be no waste of material.

SUMMARY OF THE INVENTION

According to the invention, this problem is solved using a rhombus, having two first fold lines running radially from a first obtuse corner and a central fold line forming four triangles, of which two triangles are symmetrically congruent about the central fold line, whereby the two outer triangles serve as fixing areas in a common plane while the central fold line forms a hook topped rhombus. The inner triangles are each subdivided into two triangles by a second fold line running from the second obtuse corner radially to cuts in the first fold lines, of which the smaller triangles, one on top of the other, form a supporting surface lying in the fixing plane. The two larger triangles project away from the fixing plane.

The advantage of this construction lies in a simple manner of production. There no waste by wrong cuts. The total rhombus area is used without any waste. On a large-sized raw material area, any number of adjacent rhombuses can be cut out or stamped out. In use, stability is furnished solely by the triangle areas arranged adjacent to or one on top of the other of which the edges, mutually support each other.

BRIEF DESCRIPTION OF THE DRAWINGS

Further details, features and advantages of the invention result from the attached drawing showing a preferred embodiment of the invention, wherein.

DETAILED DESCRIPTION OF THE PREFERRED EMBODIMENT

Figure 1:
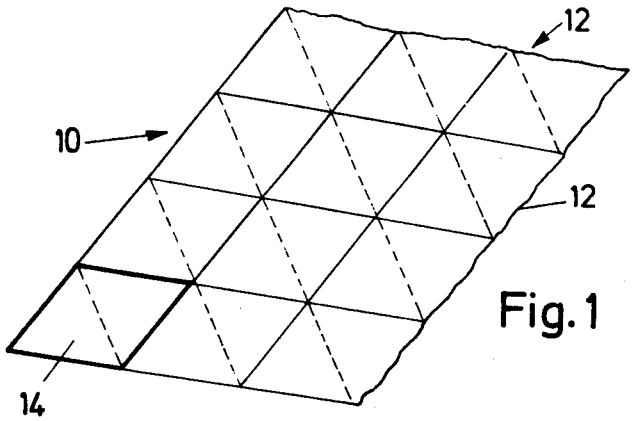
FIG. 1 is a perspective schematic view of a cardboard or the like fragment out of which hooks according to the invention are to be made.

According to FIG. 1, the efficient production of a hook according to the present invention starts from an area fragment 10 of any material. The size of the area fragment 10 is variable, and in the drawing of FIG. 1 two edges 12 are shown as being rough or torn in order to indicate that the size of the area is not limited.

The area fragment 10 is subdivided into individual rhombic area pieces 14, all being adjacent to each other and preferably of the same size within an area piece 10.

Figure 2:
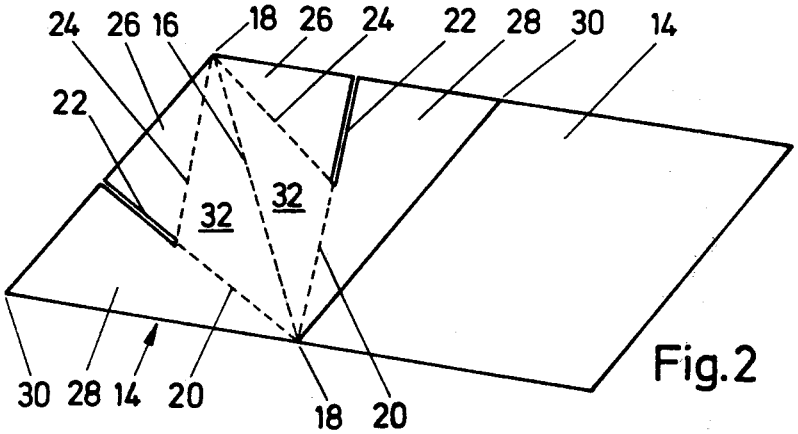
FIG. 2 is a section of the fragment according to FIG. 1.

From the drawing according to FIG. 2 it will be seen how an individual rhombus 14 is subdivided in detail. The individual rhombus 14 is an equilateral quadrangle with optional corner angles. This rhombus 14 is diagonally divided by a center fold line 16 between the two obtuse or corners 18. On both sides of the center fold line 16 further divisions are made symmetrical to this fold line. At first, from the lower obtuse angle 18 of the rhombus 14, two angle-bisecting fold lines 20 extend radially from the blunt corner 18 and their upper portions are rectilinearly graded into continuing cuts 22. From the inner end of each cut 22, another fold line 24 extends to the upper obtuse angle 18. Two triangles 26 are thus formed starting from the upper obtuse angle 18, being limited at first by the outer rhombus edges, then by the cuts 22 and finally by the fold lines 24.

In addition thereto, triangles 28 are formed. A lateral edge of each triangle 28 is formed by an outer edge of the rhombus 14 between the lower obtuse angle 18 and an acute angle 30. Adjacent thereto is the triangle side running along the other outer rhombus edge, from an acute angle 30 to the beginning of a cut 22. The third side of each triangle 28 is formed by a cut 22 itself and the fold line 20. Inside triangles 32 have a common side in the fold line 16. The two other sides of the triangles 32 are formed by the fold lines 20 and 24.

In the process of manufacture, the folding pattern described above is configured in a known manner by punching and stamping. The fold lines are stamped or scratched in and the cut lines are stamped out.

In order to convert the punched and stamped blank of FIG. 2 into a hook according to the invention, the individual rhombi 14 are separated from each other and put on the market together with instructions for folding-up and fixing. The backs of the triangles 28 and 26 may be provided with a foil-protected adhesive.

Figure 3:
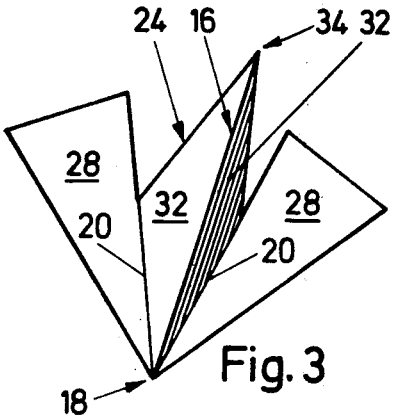
FIG. 3 is a perspective top view on a completely folded-up hook cemented to a planar support.
Figure 4:
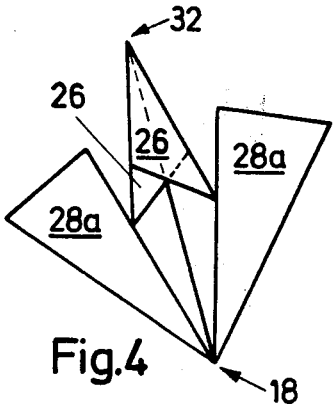
FIG. 4 is a perspective rear view, e.g. through a glass plate, of the folded-up hook.

The drawings of FIGS. 3 and 4 show the folded-up hook. According to FIG. 3, the completely folded-up hook with its planar triangle surfaces 28 is glued onto a base surface such as a wall. The two triangles 32 form the actual hook with a hook point 34. The fold line 16 runs to the peak of the hook. The triangles 26 are folded to the back around the fold lines 24 and glued one on top of the other, as shown in FIG. 4. In FIG. 4 the triangles 28 are subscripted by an "*a*" to designate the back.

The hook, being self-sealing or fixable in any other manner on any base whatever, can be made in different sizes depending on intended use, of cardboard, paper or any other suitable foldable material, and can be used to hang up objects of all kinds, especially articles of clothing, hand-bags and towels. Due to its requiring only little space while not yet folded up, the hook can easily be taken along when travelling or going abroad, and can be easily removed after use without leaving any damage.

I claim:

1. A foldable support hook blank formed of cardboard, paper or the like for hanging objects such as articles of clothing, handbags, towels, etc., comprising:

(a) a rhombus (14) having two diagonally opposite obtuse corners (18), (b) a first fold line (16) extending between the obtuse corners, (c) a pair of second fold lines (20) each extending radially from one of the obtuse corners to adjacent outer edges of the rhombus, said second fold lines being symmetrical about said first fold line, (d) a pair of equal length cuts (22) individually extending inwardly from said outer edges along the second fold lines, and (e) a pair of third fold lines (24) individually extending radially from the other obtuse corner to the inner ends of said cuts, (f) whereby a first pair of congruent triangles (28) is formed outward of the second fold lines, a second pair of congruent triangles (26) is formed outward of the third fold lines, and a third pair of congruent triangles (32) remains on opposite sides of the first fold line, the first pair of triangles being adapted to remain in a common plane, after the blank is folded, for attachment to a support surface, the second pair of triangles being adapted to be folded to partially overlie each other and to be secured together, and the third pair of triangles forming a hook member projecting outwardly from said common plane.

2. A foldable support hook blank as defined in claim 1, further comprising adhesive means applied to the backs of the first triangles and at least one of the second triangles.

3. A foldable support hook blank as defined in claim 1, wherein the second fold lines bisect the angles between the first fold line and the edges of the rhombus adjacent said one obtuse corner.

4. A foldable support hook blank as defined in claim 2, wherein the second fold lines bisect the angles between the first fold line and the edges of the rhombus adjacent said one obtuse corner.

* * * * *